US005588860A

United States Patent [19]

Uchiyama

[11] Patent Number: 5,588,860

[45] Date of Patent: Dec. 31, 1996

[54] BULB SOCKET

[75] Inventor: Takahiro Uchiyama, Yokkaichi, Japan

[73] Assignee: Sumitomo Wiring Systems, Ltd., Japan

[21] Appl. No.: 277,770

[22] Filed: Jul. 20, 1994

[30] Foreign Application Priority Data

Aug. 6, 1993 [JP] Japan ..... 5-215035

[51] Int. Cl.[6] ..... H01R 4/48

[52] U.S. Cl. ..... 439/336; 439/842; 439/918

[58] Field of Search ..... 439/332, 335, 439/336, 613, 614, 616, 617, 619, 542, 842, 843, 918

[56] References Cited

U.S. PATENT DOCUMENTS

| | | | |
|---|---|---|---|
| 4,653,841 | 3/1987 | Plyler | 439/918 |
| 4,804,343 | 2/1989 | Reedy | 439/918 |
| 5,035,643 | 7/1991 | Florish et al. | 439/918 |
| 5,306,173 | 4/1994 | Suzuki | 439/918 |
| 5,320,553 | 6/1994 | Ogawa et al. | 439/336 |

FOREIGN PATENT DOCUMENTS 4-101305 9/1992 Japan .

*Primary Examiner*—Hien D. Vu
*Attorney, Agent, or Firm*—Oliff & Berridge

[57] ABSTRACT

A bulb socket for receiving a bulb which has a plus electrode and a minus electrode comprises a socket housing, a plus terminal and a minus terminal. The plus terminal is mounted in the socket housing, and includes a bulb-side plus terminal portion for electrically connecting with the plus electrode of the bulb and a feeder-side plus terminal portion for electrically connecting with an external plus terminal. The bulb-side plus terminal portion and the feeder-side plus terminal portion are disposed in a juxtaposed condition within the socket hosing. The minus terminal is mounted in the socket housing, and includes a bulb-side minus terminal portion for electrically connecting with the minus electrode of the bulb and a feeder-side minus terminal portion for electrically connecting with an external minus terminal. The bulb-side minus terminal portion and the feeder-side minus terminal portion are disposed in a juxtaposed condition within the socket hosing.

6 Claims, 3 Drawing Sheets

PRIOR ART

BULB SOCKET

BACKGROUND OF THE INVENTION

This invention relates to a bulb socket suited for use, for example, in a combination lamp of a vehicle.

For example, in a rear combination lamp of a vehicle, a bulb is attached through a bulb socket to a back cover mounted between a trunk room and a rear portion of the vehicle. In such a bulb socket as shown in FIG. 4, a socket housing 2 of a substantially tubular shape is mounted through a gasket 1*b* in a mounting hole 1*a* in a back cover 1. Engagement pins 3*b* that project from a peripheral surface of a base 3*a* of a bulb 3 are engaged respectively in J-shaped grooves 2*a* formed in an inner peripheral surface of the socket housing 2. A plus metal terminal 4 and a minus metal terminal 5 are provided within the socket housing 2 in which the bulb 3 is to be fitted. A bulb-side plus terminal 4*a*, which is curved into a S-shape, and is adapted to contact a plus metal terminal 3*c* of the bulb 3, is formed at one end of the plus metal terminal 4, and a feeder-side male terminal 4*b*, constituting a feeder-side connection portion, is formed at the other end of this plus metal terminal. A bulb-side minus terminal 5*a*, adapted to abut against the base 3*a* of the bulb 3, is formed at one end of the minus metal terminal 5. A feeder-side male terminal (not shown), constituting a feeder-side connection portion, is formed at the other end of this minus metal terminal. The feeder-side male terminal 4*b* is disposed within a connector housing 6 which projects downwardly beyond a bottom surface 2*b* of the socket housing 2. The feeder-side male terminal 4*b* is connected to a female terminal 8, which is inserted into the connector housing 6 through a rubber ring 7, to constitute the feeder-side connection portion. The feeder-side male terminal 4*b* is connected to an exterior feeder side. This feeder-side connection portion projects from the bottom surface 2*b* of the socket housing 2 by a distance generally equal to the overall length of the female terminal 8.

However, the above bulb socket has the feeder-side connection portion projected long from the bottom surface 2*b* of the socket housing 2, and therefore the dimension of the bulb socket projecting from the back cover 1 toward the trunk room is long. As a result, when the bulb socket is to be mounted on the back cover mounted in a lamp-mounting space formed between the trunk room and the rear portion of the vehicle, the dimension of the bulb socket projecting from the back cover toward the trunk room is long, so that a sufficient operating space is not available, which has resulted in a problem that the efficiency of the mounting operation is lowered.

SUMMARY OF THE INVENTION

The present invention has been made in view of the above problem, and an object of the invention is to provide a bulb socket in which the dimension of projecting of a rear portion of a socket housing can be reduced.

In order to solve the above problem, the present invention provides a bulb socket which comprises a socket housing, a plus terminal and a minus terminal. The plus terminal is mounted in the socket housing, and includes a bulb-side plus terminal portion for electrically connecting with a plus electrode of a bulb and a feeder-side plus terminal portion for electrically connecting with an external plus terminal. The bulb-side plus terminal portion and the feeder-side plus terminal portion are disposed in a juxtaposed condition within the socket hosing. The minus terminal is mounted in the socket housing, and includes a bulb-side minus terminal portion for electrically connecting with a minus electrode of the bulb and a feeder-side minus terminal portion for electrically connecting with an external minus terminal. The bulb-side minus terminal portion and the feeder-side minus terminal portion are disposed in a juxtaposed condition within the socket hosing.

In the bulb socket of the present invention, the bulb-side terminal portion and the feeder-side terminal portion are disposed in a juxtaposed condition within the socket housing, and therefore any portion projecting from the bottom surface of the socket housing can be eliminated. With this arrangement, the overall length of the socket housing can be reduced, and when this construction is actually mounted, the space occupied by the bottom side of the socket housing can be reduced.

As described above, with the use of the bulb socket of the present invention, no portion projects from the bottom surface of the socket housing, and therefore there are achieved excellent advantages that the overall length of the socket housing can be reduced, and that even when this construction is to be mounted at a narrow place, the efficiency of the mounting operation is enhanced.

DETAILED DESCRIPTION OF THE PREFERRED EMBODIMENTS

Figure 2:
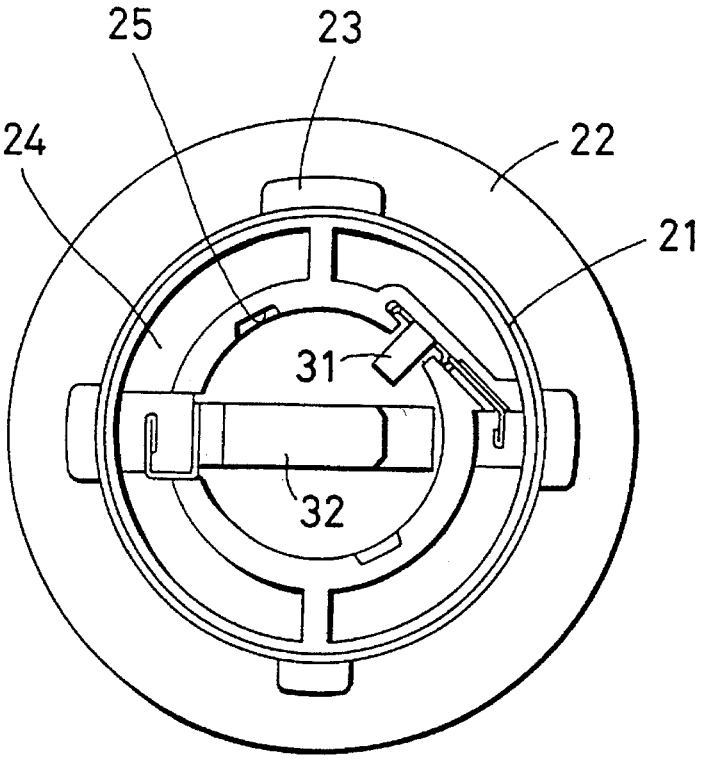
FIG. 2 is a plan view of the bulb socket.
Figure 3:
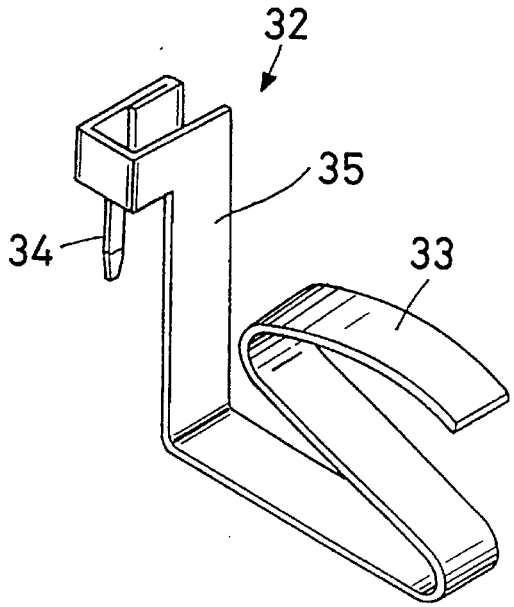
FIG. 3 is a perspective view of a plus terminal.
Figure 4:
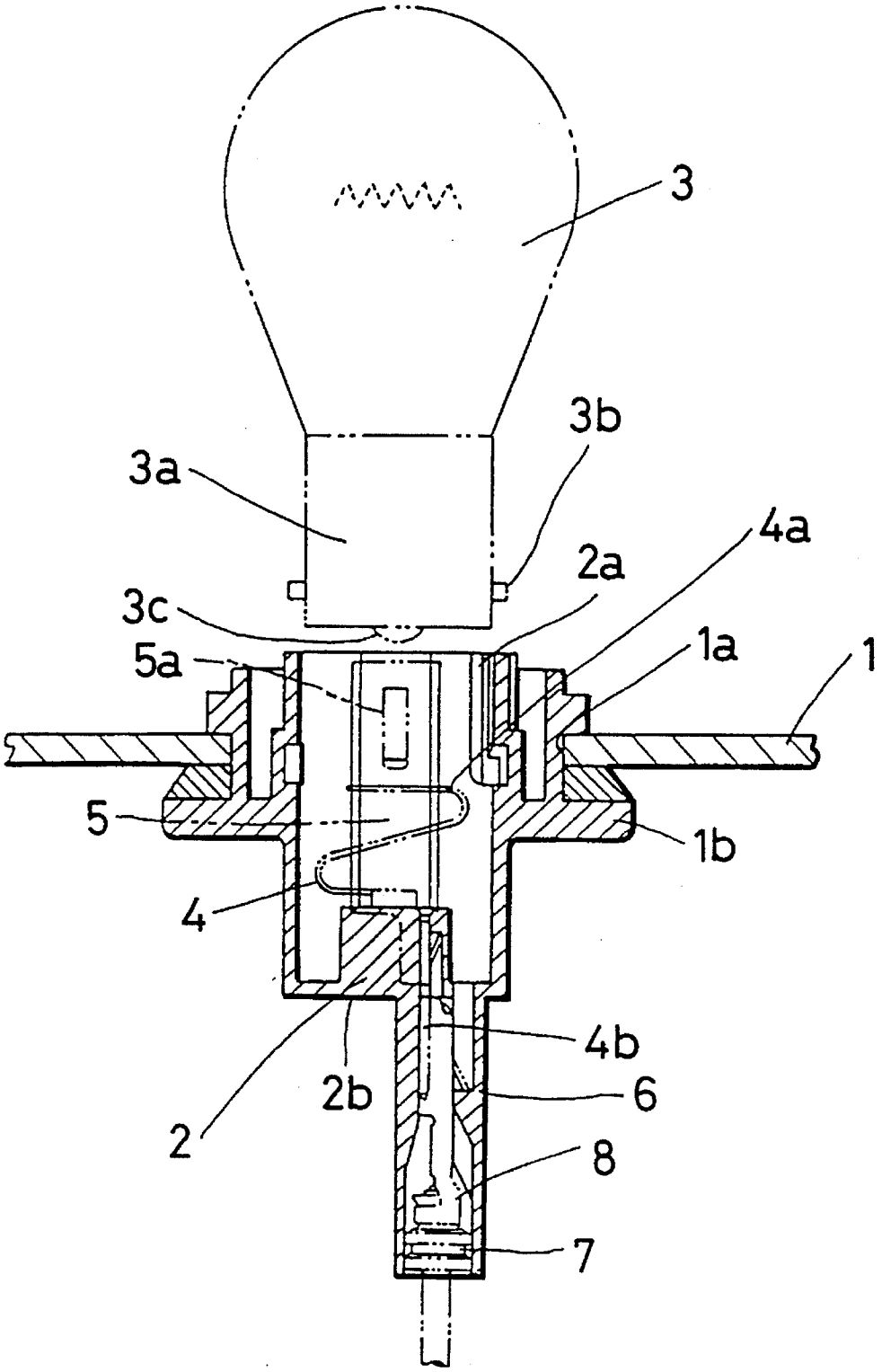
FIG. 4 is a vertical cross-sectional view showing a conventional bulb socket.

A preferred embodiment of the present invention will now be described with reference to FIGS. 1 to 3.

This embodiment is directed to a bulb socket 20 to which a bulb B, used in a rear combination lamp of a vehicle, is adapted to be attached. As shown in FIG. 1, the bulb B comprises a bulb member a in which a filament is sealed, and a base b of electrically-conductive material mounted on a bottom portion of the bulb member a. A bulb electrode c connected to a plus side of the filament is mounted on the bottom of the base b through an insulation material, and a peripheral surface of the base b serves as a minus feeder electrode. A pair of mounting pins d (only one of which is shown) for attaching the bulb to a bulb socket 20 are formed on the peripheral surface of the base b.

Figure 1:
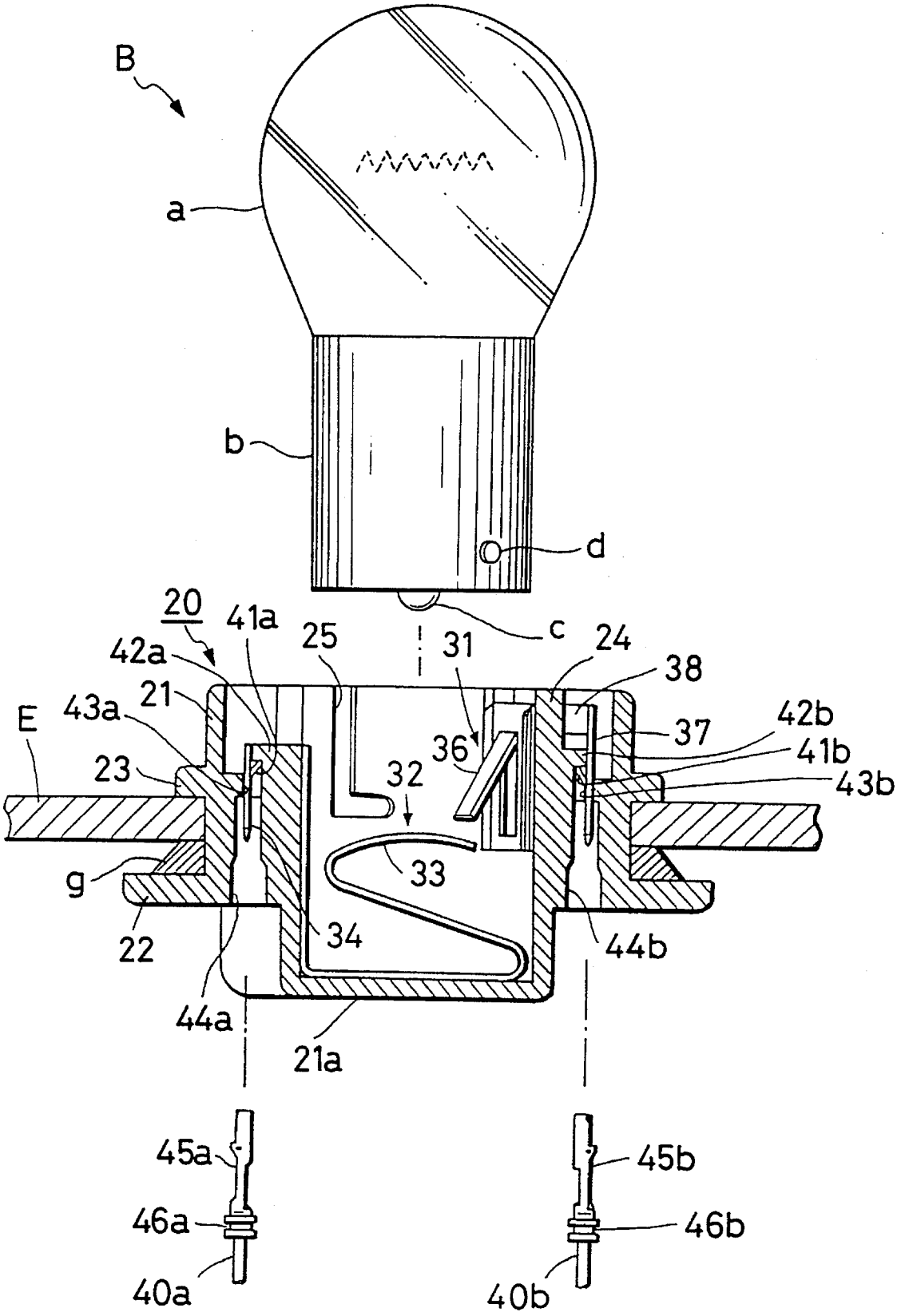
FIG. 1 is a vertical cross-sectional view of a bulb socket.

As shown in FIG. 1, the bulb socket 20 for receiving this bulb B comprises a socket housing 21 of a generally cylindrical shape, and a gasket g for mounting this socket housing 21 on a back cover E in an air-tight manner.

A flange 22 is formed on the outer periphery of the socket housing 21, and is disposed adjacent to the bottom of this socket housing. The gasket g is held between the flange 22 and the back cover E, and in this condition the socket housing 21 is rotated, so that socket mounting projections 23 which are formed on right and left portions of the peripheral surface of the socket housing are engaged with a mounting hole formed in the back cover E, thereby mounting the socket housing in an air-tight manner (see FIG. 2).

A bulb hood 24 of a cylindrical shape is provided within the socket housing 21. This bulb hood 24 is fitted on the base b of the bulb B. J-shaped grooves 25 are formed in the inner peripheral surface of the bulb hood 24, and can receive the mounting pins d of the base b, respectively, so as to mount the bulb B.

A minus terminal 31 for contact with the minus feeder electrode of the base b is mounted on the inner peripheral surface of the bulb hood 24. A plus terminal 32 for contact with the bulb electrode c is mounted on the bottom surface of the bulb hood 24. As shown in FIG. 3, the plus terminal 32 includes a bulb-side plus terminal piece 33 defined by a resilient contact portion of a generally S-shape, a feeder-side plus terminal piece 34 for connection to a feeder 40*a* for supplying power to the bulb B, and a connecting piece 35 holding the two terminal pieces in a juxtaposed condition. This plus terminal 32 is formed by bending a single electrically-conductive metal plate.

As shown in FIG. 1, the plus terminal 32 is inserted into the bulb hood 24 in a direction of the length of this bulb hood, and a resilient withdrawal prevention piece 41*a* is engaged with a retaining portion 42*a* of the bulb hood 24, thereby securing this plus terminal to the bulb hood. The bulb-side plus terminal piece 33, forming the generally S-shaped, resilient contact portion, is disposed within the bulb hood 24 so as to abut against the bulb electrode c formed on the bottom surface of the bulb B. The feeder-side plus terminal piece 34 formed at the other end of the plus terminal is in the form of a tab defining a connection portion for connection to the feeder 40*a* for supplying power to the bulb B. This tab extends through a hole 43*a* into a connection hole 44*a* formed in a back surface of the socket housing 21.

On the other hand, the minus terminal 31 includes a bulb-side minus terminal piece 36 serving as a resilient contact portion for contact with the minus feeder electrode of the base b of the bulb B, a feeder-side minus terminal piece 37 for connection to a feeder 40*b*, and a connecting piece 38 holding the two terminal pieces in a juxtaposed condition. This minus terminal is formed by bending a single electrically-conductive metal plate. The minus terminal 31 is inserted into the bulb hood 24 in the direction of the length of this bulb hood, and a resilient withdrawal prevention piece 41*b* is engaged with a retaining portion 42*b* of the bulb hood 24, thereby securing the minus terminal to the bulb hood. The bulb-side minus terminal piece 36, defining the tongue-like resilient contact portion, is adapted to abut against the base b of the bulb B received in the bulb hood 24. The feeder-side minus terminal piece 37, formed at the other end of the minus terminal, is in the form of a tab defining a connection portion for connecting the feeder 40*b* to the bulb B. This tab extends through a hole 43*b* into a connection hole 44*b* formed in the back surface of the socket housing 21.

Receptacles 45*a* and 45*b* are attached respectively to the feeders 40*a* and 40*b* for supplying power to the bulb B, and can be fitted on and connected to the feeder-side plus terminal piece 34 and the feeder-side minus terminal piece 37, respectively. Waterproof rubber packings 46*a* and 46*b* are mounted respectively on proximal end portions of the receptacles 45*a* and 45*b*, and can be fitted in the connection holes 44*a* and 44*b*, respectively.

Next, the operation of this embodiment will now be described.

When the bulb B is attached to the bulb hood 24 of the bulb socket 20, the bulb electrode c of the bulb B and the base b are resiliently contacted respectively with the plus terminal 32 and the minus terminal 31, thereby making electrical connection therebetween.

At this time, the bulb-side plus terminal piece 33 and the feeder-side plus terminal piece 34 of the plus terminal 32 are disposed in a juxtaposed condition within the bulk, socket 20. Also, the bulb-side minus terminal piece 36 and the feeder-side minus terminal piece 37 of the minus terminal 31 are disposed in a juxtaposed condition within the bulb socket 20.

Therefore, with the use of the bulb socket 20 of this embodiment, no portion projects from a bottom surface 21*a* of the socket housing 21, and therefore the overall length of the socket housing 21 can be reduced, and even when a rear combination bulb of a vehicle or the like is to be mounted in a confirmed location, the efficiency of the mounting operation is enhanced.

Moreover, if there is obtained generally the same operation space as available with the conventional construction, the capacity of a trunk room can be increased by an amount corresponding to the amount of reduction of the overall length of the socket housing 21.

The present invention is not limited to the above embodiment, and for example, instead of the bulb B, a wedge base bulb can be used.

Although each of the plus terminal and the minus terminal 31 is formed by bending a single electrically-conductive metal plate, each terminal may be formed, for example, in such a manner that the two terminal pieces of each terminal are separate from each other, and are connected together in an electrically conductive manner.

Although the bulb B has the single bulb electrode c, the invention can be applied to the type in which two bulb electrodes and one common electrode are provided.

What is claimed is:

1. A bulb socket for receiving a bulb having a plus electrode and a minus electrode, said bulb socket comprising:

a socket housing having a bottom wall, an outer side wall, an inner side wall and retaining portion, said bottom wall and inner side wall defining a bulb receiving portion, said outer side wall surrounding the inner side wall, and said retaining portions being disposed between the inner and outer side walls, a bottom surface of the retaining portions having spaced openings of connection holes extending at least partially therethrough in an axial direction of the socket housing;

a plus terminal mounted in said socket housing, said plus terminal including a bulb-side plus terminal portion for electrically connecting with the plus electrode of the bulb and a feeder-side plus terminal portion for electrically connecting with an external plus terminal, said bulb-side plus terminal portion and said feeder-side plus terminal portion being disposed in a juxtaposed condition within said socket housing; and a minus terminal mounted in said socket housing, said minus terminal including a bulb-side minus terminal portion for electrically connecting with the minus electrode of the bulb and a feeder-side minus terminal portion for electrically connecting with an external minus terminal, said bulb-side minus terminal portion and said feeder-side minus terminal portion being disposed in a juxtaposed condition within said socket housing, wherein said feeder-side plus terminal portion and said feeder-side minus terminal portion each have a portion that extend in the axial direction within the connection holes of the retaining portions.

2. A bulb socket according to claim 1, wherein said feeder-side plus terminal portion and said feeder-side minus terminal portion are disposed at a same height from said bottom wall of said socket housing.

3. A bulb socket having a bulb secured therein, said bulb comprising a bulb member, a base having a lower periphery, a bulb plus electrode and a bulb minus electrode, said bulb socket comprising:

a socket housing having a bottom wall an outer side wall, an inner side wall and retaining portions, said bottom wall and inner side wall defining a bulb receiving portion, said outer side wall surrounding the inner side wall, and said retaining portions being disposed between the inner and outer side walls, a bottom surface of the retaining portions having spaced openings of connection holes extending at least partially therethrough in an axial direction;

a socket plus terminal mounted in said socket housing, said socket plus terminal including a bulb-side socket plus terminal portion that electrically connects with the bulb plus electrode and a feeder-side socket plus terminal portion that electrically connects with an external plus terminal, said bulb-side socket plus terminal portion and said feeder-side socket plus terminal portion being disposed in a juxtaposed condition within said socket housing; and a socket minus terminal mounted in said socket housing, said socket minus terminal including a bulb-side socket minus terminal portion that electrically connects with the bulb minus electrode and a feeder-side socket minus terminal portion that electrically connects with an external minus terminal, said bulb-side socket minus terminal portion and said feeder-side socket minus terminal portion being disposed in a juxtaposed condition within said socket housing, wherein said feeder-side socket plus terminal portion and said feeder-side socket minus terminal portion each have a portion that extends in the axial direction within the connection holes of the retaining portions.

4. A bulb socket having a bulb according to claim 3, wherein said feeder-side plus terminal portion and said feeder-side minus terminal portion are disposed at a same height from said bottom wall of said socket housing.

5. A bulb socket having a bulb according to claim 3, wherein said lower periphery is disposed adjacent said bottom wall of said bulb socket when said bulb is inserted therein.

6. A bulb socket having a bulb according to claim 3, wherein said base of said bulb includes an upper periphery and said bulb socket includes an upper end portion that defines an upper plane, said upper periphery of said base being disposed adjacent said top portion of said bulb socket when said bulb is inserted therein.

* * * * *